US010065192B2

(12) United States Patent
Frangenberg

(10) Patent No.: US 10,065,192 B2
(45) Date of Patent: Sep. 4, 2018

(54) MACHINE FRAME FOR A ROLL PRESS

(71) Applicant: TAKRAF GMBH, Leipzig (DE)

(72) Inventor: Meinhard Frangenberg, Kürten-Engeldorf (DE)

(73) Assignee: TAKRAF GMBH, Leipzig (DE)

( * ) Notice: Subject to any disclaimer, the term of this patent is extended or adjusted under 35 U.S.C. 154(b) by 149 days.

(21) Appl. No.: 14/944,545

(22) Filed: Nov. 18, 2015

(65) Prior Publication Data

US 2016/0136649 A1 May 19, 2016

(30) Foreign Application Priority Data

Nov. 18, 2014 (DE) ..... 10 2014 223 524

(51) Int. Cl.

| | |
|---|---|
| ***B02C 4/00*** | (2006.01) |
| ***B02C 4/32*** | (2006.01) |
| ***B30B 3/04*** | (2006.01) |
| ***B30B 15/04*** | (2006.01) |
| ***B02C 4/28*** | (2006.01) |

(52) U.S. Cl.

CPC ..... *B02C 4/32* (2013.01); *B02C 4/28* (2013.01); *B30B 3/04* (2013.01); *B30B 15/04* (2013.01)

(58) Field of Classification Search

CPC .. B02C 4/32; B02C 4/28; B30B 15/04; B30B 3/04

See application file for complete search history.

(56) References Cited

U.S. PATENT DOCUMENTS

| | | | | |
|---|---|---|---|---|
| 344,258 | A * | 6/1886 | Dunne | B30B 3/04 241/230 |
| 4,101,083 | A | 7/1978 | Faist | |
| 9,289,959 | B2 * | 3/2016 | Frangenberg | B02C 4/02 |
| 2008/0217451 | A1 * | 9/2008 | Frangenberg | B02C 4/02 241/227 |
| 2010/0186607 | A1 * | 7/2010 | Horster | B02C 4/02 100/176 |
| 2013/0025476 | A1 | 1/2013 | Frangenberg | |
| 2013/0087054 | A1 | 4/2013 | Frangenberg | |

FOREIGN PATENT DOCUMENTS

| | | | |
|---|---|---|---|
| CA | 2891381 | A1 | 6/2014 |
| CN | 1114918 | A | 1/1996 |
| CN | 202683265 | U | 1/2013 |
| CN | 104088959 | A | 10/2014 |
| DE | 1 296 938 | B | 6/1969 |
| DE | 26 10 742 | A1 | 9/1977 |
| DE | 10 2005 045 273 | A1 | 3/2007 |
| DE | 10 2005 061 085 | A1 | 6/2007 |
| DE | 10 2010 015 374 | A1 | 10/2011 |
| DE | 10 2010 024 231 | A1 | 12/2011 |
| EP | 1 374 999 | A2 | 1/2004 |
| GB | 1390574 | A | 4/1975 |
| WO | 2006/084652 | A1 | 8/2006 |
| WO | 2012/151641 | A1 | 11/2012 |
| WO | 2013/104646 | A1 | 7/2013 |
| WO | 2014/173875 | A1 | 10/2014 |

* cited by examiner

*Primary Examiner* — Faye Francis
(74) *Attorney, Agent, or Firm* — McGlew and Tuttle, P.C.

(57) ABSTRACT

A machine frame (1) for a roll press. This machine frame has an axial frame (2) for absorbing axial forces developing due to the operation and at least two radial frames (3) for absorbing radial forces developing due to the operation. The elements (36) of the radial frame (3), which absorb the radial forces, are mounted elastically in the machine frame (1).

18 Claims, 4 Drawing Sheets

MACHINE FRAME FOR A ROLL PRESS

CROSS REFERENCE TO RELATED APPLICATIONS

This application claims the benefit of priority under 35 U.S.C. § 119 of German Patent Application DE 10 2014 223 524.3 filed Nov. 18, 2014, the entire contents of which are incorporated herein by reference.

FIELD OF THE INVENTION

The present invention pertains to a machine frame for a roll press.

BACKGROUND OF THE INVENTION

Roll presses are machines for the size reduction of material beds with usually two rollers, which are also called rolls and are arranged in a machine frame. To reduce the size of beds of material, the particles are drawn into a roll gap, pressed against one another by the high pressure exerted by the rolls and they mutually reduce each other's size. One of the rolls is usually designed as a fixed roll and one as a movable roll. Roll presses are also called cylinder crushers or roller presses and are used in cement production as well as in mining.

The machine frame must absorb the strong radial forces and, moreover, the occurring axial forces. A twisting of the machine frame is to be avoided, because such leads to incorrect positioning of the rolls and hence to an inhomogeneous pressure distribution accompanied by a deterioration of the result of size reduction. The rolls are guided with their bearings in the machine frame and are held in position in the axial direction, and an oblique position and the possibility of a horizontal motion of the rolls and the bearing thereof in the frame are at the same time made possible. The movable roll has a markedly greater freedom of motion than the fixed roll due to being supported by hydraulic cylinders.

It is regularly necessary for maintenance and repairs to remove the rolls from the machine frame. End pieces that can be quickly removed, by means of which the frame can be opened on one side and the rolls can be removed in the horizontal direction, are frequently provided for this on at least one side of the frame.

DE 10 2005 061 085 A1 describes a roll press, which has a cuboid, closed frame, comprising an upper chord and a lower chord. The radial forces are absorbed by the chords as pulling forces. The axial forces are introduced into supports, which are fastened laterally to the chords and axially define the rolls. The chords are also loaded now with a component of the weight of the rolls. The drawback of this machine frame for a roll press is the heavy weight and the great effort needed for disassembly for repair purposes.

DE 10 2005 045 273 A1 shows a roll press, having a machine frame comprising a plurality of welded elements, which are connected to one another by a shearing pin screw connection. The mounted rolls, one being a movable roll with hydraulic support and the other being a fixed roll, are guided slidingly with low friction in the frame. The closed frame absorbs the pressing forces in the radial and axial directions and therefore has a correspondingly rigid design. The frame can be opened easily and rapidly on the fixed roll side, so that the mounted rolls can be rapidly removed and installed in the horizontal direction. The drawback is that the manufacture of this frame requires a large amount of material and is therefore cost-intensive. The repair of the frame is expensive as well.

DE 10 2010 015 374 A1 also shows a machine frame for a roll press. The frame is likewise of a cuboid design, but the screw and pin connections were replaced by welded connections by means of a U-shaped connection piece having two legs (tuning fork shape). This frame has a markedly lower weight than the above-described one, but it can absorb the occurring axial forces to a limited extent only because of the "open" frame design on one side, which is dictated by the function, and it would therefore disadvantageously twist during operation.

SUMMARY OF THE INVENTION

An object of the present invention is to propose a machine frame of a simple design for a roll press, which machine frame can be manufactured easily and mounted rapidly and which can absorb the radial and axial forces occurring without twisting.

The object is accomplished by the machine frame being subdivided according to the acting forces into mutually intersecting frame parts. The machine frame according to the present invention for a roll press has an axial frame and at least two radial frames. The terms axial frame and radial frame mean that the axial frame absorbs the axial forces of the rolls, especially the weight, and forces that develop in case of an oblique position of the movable roll, and the radial frame absorbs the radial forces of the rolls, especially the pressing forces. The radial frame is consequently aligned at right angles to the axes of rotation of the rolls. The radial frames are of a rectangular design, i.e., they form a flat formation each with four support-like frame elements. The planes formed by the individual frames are connected in the assembled state such that they are arranged at right angles crosswise and thus form a cuboid. The means for absorbing the radial forces are not mounted rigidly but elastically in the machine frame. As a result, the radial forces are advantageously not transmitted to the axial frame.

In another preferred embodiment of the machine frame according to the present invention, the upper part and the lower part of the axial frame have sliding means for the sliding motion of the mounted rolls, preferably guideways. The lower part of the axial frame thus absorbs the weight of the rolls, in addition to the axially acting operating forces. A horizontal, low-friction sliding of the hydraulically supported movable roll in the frame is preferably achieved by the Teflon (polytetrafluoroethylene (PTFE))/polished chromium sheet sliding pairing. Polished chromium sheets are preferably arranged on the upper part and lower part of the axial frame, and chambered sliding plates made of Teflon (polytetrafluoroethylene (PTFE)) are located as an opposing sliding surface on the bearing housing. The individual elements of this sliding pairing are preferably screwed together and can thus advantageously be replaced in a simple manner as a part subject to wear.

"Chambered" is defined such that the sliding plate made of Teflon is arranged in a depression in a support plate, so that the depression holds the sliding plate made of Teflon, and the edges of the opening in the support plate absorb the shear forces. The screw connection and/or bonding of the sliding plate must ensure as a result only the fixation of the sliding plate in the support plate.

In another preferred embodiment, the upper part and the lower part of the axial frame have, extending parallel to the radial frame on the outside, carrier plates with sliding rails.

Sliding and guide elements, via which the rolls are guided displaceably on the support plates, are arranged on the housings of the roller bearings, so that both the degree of freedom of the movable roll necessary during the operation of the roll press and the installation and removal of the rolls are possible. This sliding and guide system also contains outer guides, via which the occurring axial forces are introduced into the axial frame.

In another preferred embodiment of the machine frame according to the present invention, the radial frames have long sides and short sides, the long sides being arranged horizontally in the assembled state and the short sides being vertical. In the radial frame, the long sides comprise a chord system each, which has, designated according to the site of installation, upper chords or lower chords (close to the floor in the installed state). The short sides of the radial frames are called vertical spars. The chords are mounted in the chord system in elastic damping elements. The radial operating force is introduced into the chords via the vertical spars. There is a positive-locking connection between the chords and the vertical spars. The machine frame according to the present invention has no shearing pin screw connection between the chords and the force absorption points (chord contact surfaces for the vertical spars). The chords are subjected to tension in the stretching direction by the radial operating forces. The chords are preferably manufactured from steel plate or wide flat steel.

The radial frame preferably has the following design. The vertical spars comprise two vertically arranged, spar-like side parts extending parallel, which are connected to one another at the upper end by the axis of rotation of a hinge (vertical spar pair). The hinge is preferably fastened by means of an axis of rotation with slide bearing and slotted ground nuts. The axis of rotation carries a suspension hinge between the two spar-like side parts. The suspension hinge has a lower link. The lower link has a lower link catch hook. The upper end of the vertical spars is fastened to the axial frame by means of the lower link catch hook of the hinge. Due to these oscillating individual spars being connected via an axis of rotation and to the link geometry, the force absorption points of the chord systems are automatically contacted when these are suspended in the lower link catch hooks. The link geometry brings about a partial conversion of the vertically acting weight into a horizontal force component. The lower link catch hook, fastened to the axial frame, has a spherical mounting piece, which meshes with a complementarily shaped counterpiece of the lower link balls at the suspension hinge of the vertical spars, while preserving the degrees of freedom of motion.

The lower end of the vertical frame end pieces is inserted into cavities, which are formed from the lower axial frame, a closing part and the lower chords. The side parts preferably have insertion surfaces for this at their lower end, preferably on the sides directed away from the hinge. These insertion surfaces facilitate the insertion of the side parts into the cavities. They are preferably shaped conically for this. The insertion surfaces especially preferably have sliding coatings (for example, Teflon).

The upper and lower chords are preferably configured as two chords extending parallel to one another, which are called double chords. The chord system may also have an individual chord each with a forged head part welded to same. The double chords are connected to one another at their head ends with special hammer head-like welded constructions, the head connections. The chords extend through and between the two side parts of the vertical spars, which said side parts extend parallel. The vertical spars are supported on the head parts for head connections of the chords in the direction of the radial force. At the ends directed away from the vertical spars, the chords have an elastic damping element. The damping element of the chords is prestressed by an amount (path) that arises from the longitudinal stretching resulting from the operating force. The elastic mounting of the chords, which is prestressed by a defined path, is nearly relieved of load, i.e., stress-free during operation at nominal force.

The complicated shearing pin screw connection between the chords and the force absorption points is replaced by a welded or forged connection in this embodiment of the frame and belongs to the chord system. The mechanical connection between the vertical spar and the chord can thus be considerably stabilized and the transmission of torque improved.

The absorption of the radial forces and the absorption of the axial forces are advantageously separated to the greatest extent possible and a mutual influence was ruled out to the greatest extent possible due to the design according to the present invention of the machine frame. The shocks occurring during the operation are also reduced by the damping element. In addition, the machine frame has a simple design and individual parts of the frame can easily be replaced. Last but not least, the weight-optimized chord systems are kept parallel by the axial frame, and auxiliary supports are advantageously unnecessary.

The chord systems absorb no weights from the mounted rolls and thus also have no sliding elements for moving the movable roll. The chords are thus advantageously purely tensioned by the radial forces and undergo a symmetrical stretching that is proper for the component. Due to the lack of sliding elements, the chord systems do not need to be machined over the length in a sliding-optimized manner and can be manufactured in a cost-effective manner.

In another preferred embodiment of the machine frame according to the present invention, at least one of the vertical spar pairs of the radial frame is detachable. The vertical spars can thus advantageously be removed rapidly for removing the rolls.

In another preferred embodiment of the machine frame according to the present invention, the bearing housings of both rolls are supported in the radial frames in the horizontal direction. One of the two vertical spar pairs of a radial frame has a contact surface for this for mounting a movable roll and the other has a contact surface for mounting a fixed roll. Support is preferably ensured via a rubber thrust bearing on the fixed roll side and via a rubber thrust bearing and hydraulic cylinder on the movable roll side.

In another preferred embodiment of the present invention, a foundation plate is located under the machine frame. This foundation plate can form the support located close to the floor for the individual frames. The foundation plate is preferably manufactured by means of welded connections. Axial and radial frame parts can preferably be connected at the foundation plate by means of screw connections. The separate foundation plate, which can be aligned in a simple manner, advantageously offers a platform, which makes it possible to build up the drive and frame parts of a roll press in a simple manner and rapidly.

In another preferred embodiment, the axial frame and the radial frame are screwed to one another each via the chord system of the radial frame. In addition to the above-described chords, a chord system comprises box-like frame elements. These preferably have parallel longitudinal beam elements, between which the chords extend. The longitudinal beam elements are screwed to the upper and lower parts of the axial frame, and the radial operating forces are not transmitted according to the present invention to the axial frame elements via the screw connection due to the elastic mounting of the chords in the box-like frame elements. Furthermore, the box-like frame elements of a chord system and the axial frame are connected to one another by a vertical pin as a plug-in centering connection. The machine frame can be assembled and disassembled in a simple manner because of the screw connections, and repairs are also simpler than in case of a multipart frame welded together from horizontal and vertical frame components.

In another preferred embodiment, the radial frames are smaller than the axial frames, so that the radial frames are located within the axial frame in the assembled state. This means, so to speak, that the rolls fit through the axial frame in a direction at right angles to their axis of rotation. The removal of the rolls is thus advantageously simplified even more, because the axial frame does not have to be removed.

The so-called cross frame according to the present invention advantageously makes it possible to clearly separate the forces into the frame components intended for them, i.e., the axial frame absorbs the axial forces and the radial frames absorb the radial forces. In addition, the radial frames no longer have to absorb any weights of the rolls due to the design of the roll mounts, so that no bending moments but, to a great extent, only tensile forces act on the radial frames. Due to the fact that the axial frame does not have to be designed for absorbing the radial operating forces, the axial frame can be configured as a markedly more lightweight frame than prior-art frame forms, and a weight reduction is achieved.

Furthermore, the rolls can be removed in a very simple manner and preferably in the direction of the fixed roller because of the two large axial frames, through which the rolls can be passed. It is also preferable that removal is also possible in the direction of the movable roll.

In addition, the design of the frame as a modular system is very advantageous, because different frame components can be used for roll presses of various sizes.

The present invention will be explained below on the basis of exemplary embodiments with reference to the figures, without being limited to these.

It is also useful for embodying the present invention to combine the aforementioned designs and embodiments with one another. Preferred variants of the present invention appear from the combinations of the claims or individual features thereof.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
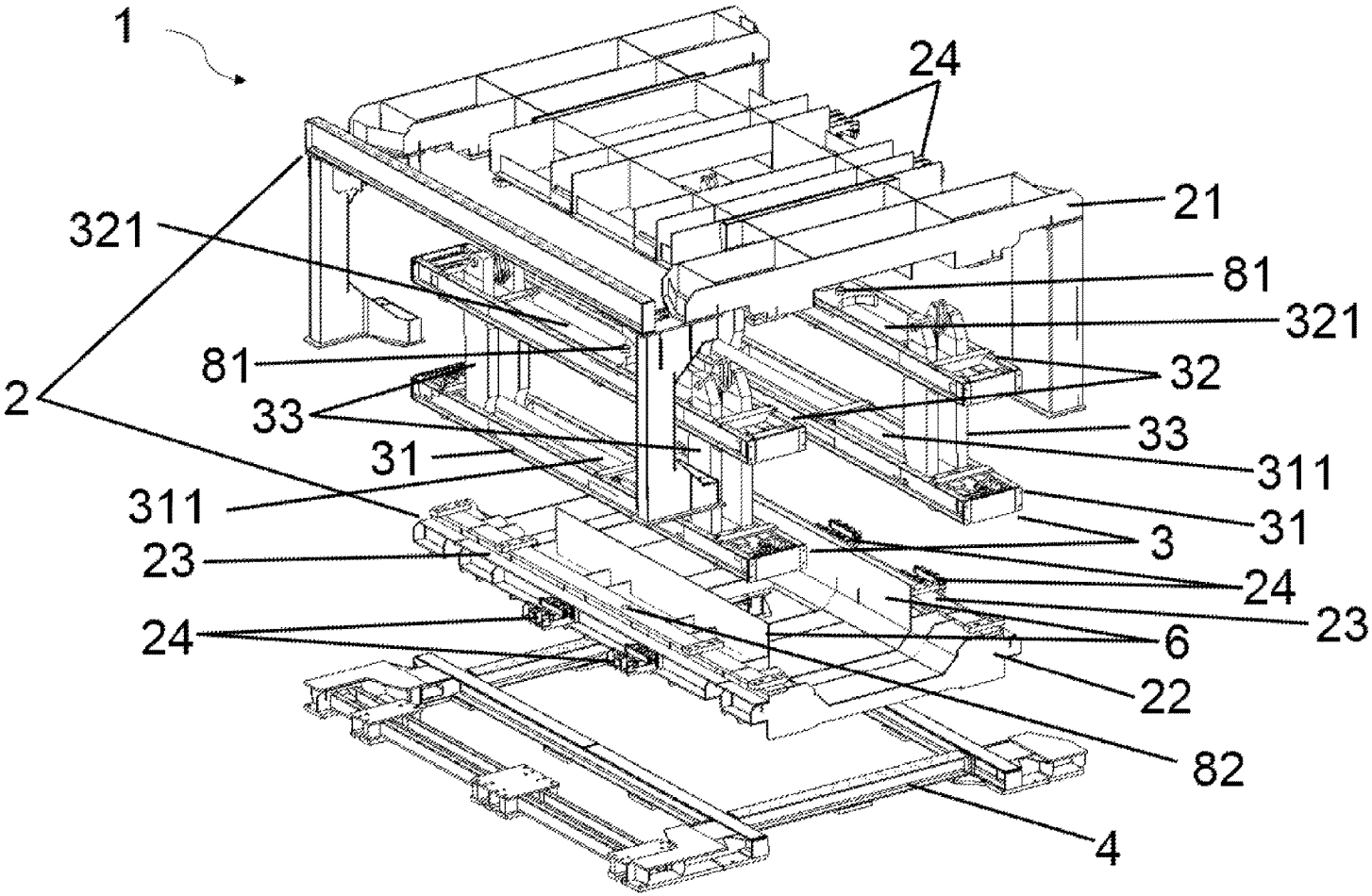
FIG. 1 is a perspective view of the design of a machine frame according to the present invention comprising individual frames, without the rolls.

Referring to the drawings, FIG. 1 shows the design of a machine frame 1 according to the present invention for a roll press. This machine frame 1 has an axial frame 2 with an axial frame upper part 21 and with an axial frame lower part 22. Two radial frames 3 are arranged at right angles thereto and within the axial frame 2. A foundation plate 4 is located under the axial frame lower part 22 near the floor. The radial frames have an upper chord system 32 each with an upper chord 321 configured as a double chord and a lower chord system 31 with a lower chord 311 configured as a double chord. The upper and lower chord systems are of identical design. The short sides of the radial frames 3 form vertical spars, which are arranged each as a vertical spar pair 33. Parallel to the chord systems 31, 32, support plates with sliding rails 23 are arranged at the axial frame upper part 21 and at the axial frame lower part 22. The rigid components of the outer guides 24 are likewise fastened to the axial frame upper part 21 and to the axial frame lower part 22. The housing 6 of the rolls, which prevents material being subjected to size reduction from entering the outside from the roll gap during the operation, is indicated at the axial frame lower part 22. The upper chord system 32 is connected to the axial frame upper part 21 and the lower chord system 31 to the axial frame lower part 22 via screw connections (mounting holes are indicated) as well as via a centering pin 81 each (at the radial frame, hidden at the bottom) with an opposing hole 82 (at the axial frame, hidden at the top).

Figure 2:
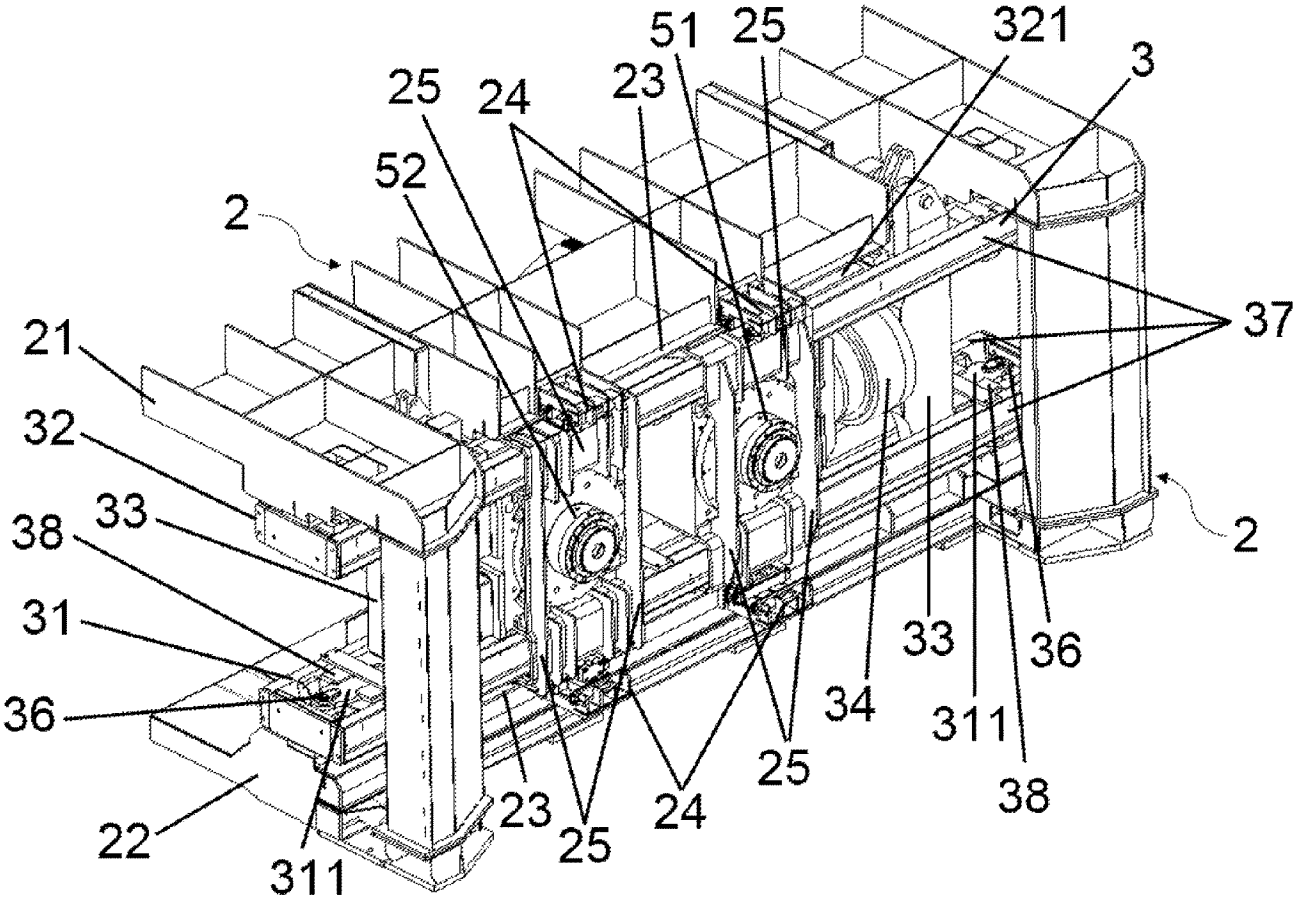
FIG. 2 is a perspective view showing one half of a machine frame according to the present invention, with rolls.

FIG. 2 shows a view of one half of a machine frame 1 according to the present invention. Shown are one half of the axial frame 2 with the axial frame upper part 21 and of the axial frame lower part 22 as well as a radial frame 3, comprising the lower chord system 31 with the lower chord 311, the upper chord system 32 with the upper chord 321 and two vertical spar pairs 33. A chord system 31, 32 comprises chords 311, 321, which are configured as double chords extending parallel here, and box frame-like brackets, which have longitudinal beam elements 37. The individual spars each of a vertical spar pair 33 mesh with the spaces between the chords 311, 321 and the longitudinal beam elements 37. The chords 311, 321 have special welded constructions or forged head connections 38 at the respective ends. The chords are mounted in elastic damping elements 36 in the chord system. The fixed roll and the movable roll of a roll press usually have a fixed bearing and a movable bearing each. Shown is the fixed bearing-side view of the machine frame with the fixed bearing 51 of the movable roll and with the fixed bearing 52 of the fixed roll 5, each with bearing housings. Both rolls are supported horizontally in the radial frame 3. The contact surface for the movable roll bearing 51 can be seen in the form of a rubber thrust bearing with hydraulic cylinder 34, which is fastened to the vertical spar pair 33. The fixed roller-side contact surface in the form of a rubber thrust bearing is hidden in the figure. Within the framework of a force regulation, the hydraulic elements on the movable roll side set the gap size between the movable roll and the fixed roll during the operation (operating gap). Slideways 25, which direct the weight of a roll around the chord systems 31, 32 into the axial frame lower part 22, are arranged at the housings of the fixed bearings. Chambered sliding plates 251, made preferably of Teflon, are arranged at the slideways 25 at the top and at the bottom (see FIG. 4).

Support plates with sliding rails 23, made preferably of polished chromium sheets, are fastened as an opposing sliding surface on the axial frame upper part 21 and on the axial frame lower part 22. The outer guide 24 has both rigid elements 241, fastened to the axial frame upper part 21 or lower part 22, as well as movable elements 242 fastened to the slideways 25 (see FIG. 4), so that the horizontal motion and oblique position of the movable roll are made possible. The outer guides 24 hold the rolls axially in position and direct the axial forces into the axial frame 2. The outer guides 24 are likewise preferably equipped with the Teflon/polished chromium sheet sliding pair.

Figure 3:
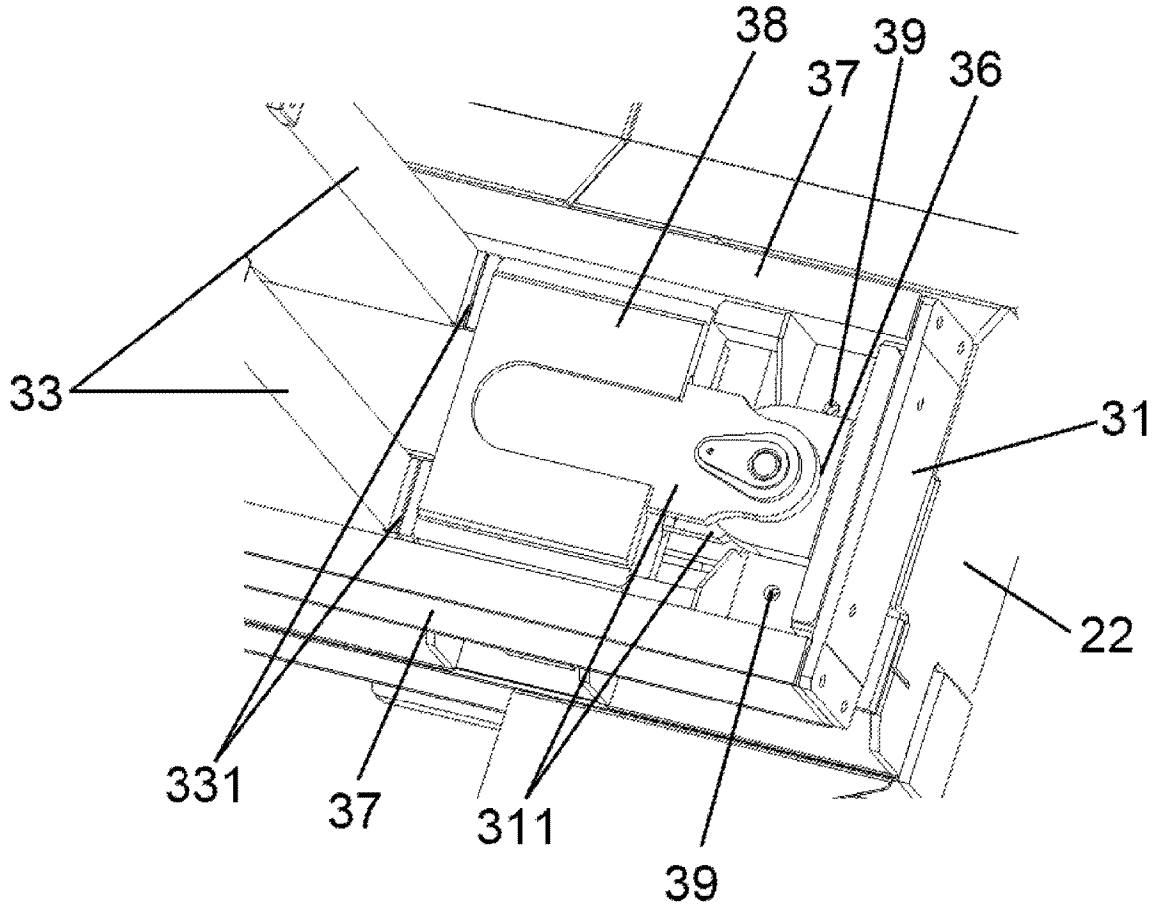
FIG. 3 is a detail view of the lower chord system of a machine frame according to the present invention.

FIG. 3 shows a detail view of the lower chord system 31 of a machine frame 1 according to the present invention, comprising the lower chords 311, which are connected by means of the welded construction 38 (head connection) and are configured a double chords extending in parallel, and the longitudinal beam elements 37 as a bracket of the chords 311. The longitudinal beam elements 37 are connected to the axial frame lower part 22 via screw connections (mounting holes 39) and a centering pin 81 with opposing hole 82 (see FIG. 1). The two individual spars of the vertical spar pair 33 are inserted between the chords 311 and the longitudinal beam elements 37. The vertical spar pair 33 absorbs the radial operating forces and transmits them to the chords 311. The chord heads with the force application surfaces 331 for introducing the radial forces from the vertical spars 33 into the chords 311 have no screw or pin connections. The chords 311 are mounted elastically in the chord system 31 via a damping element 36. As a result, the radial operating forces are not transmitted to the longitudinal beam elements 37 and hence neither to the axial frame lower part 22.

Figure 4:
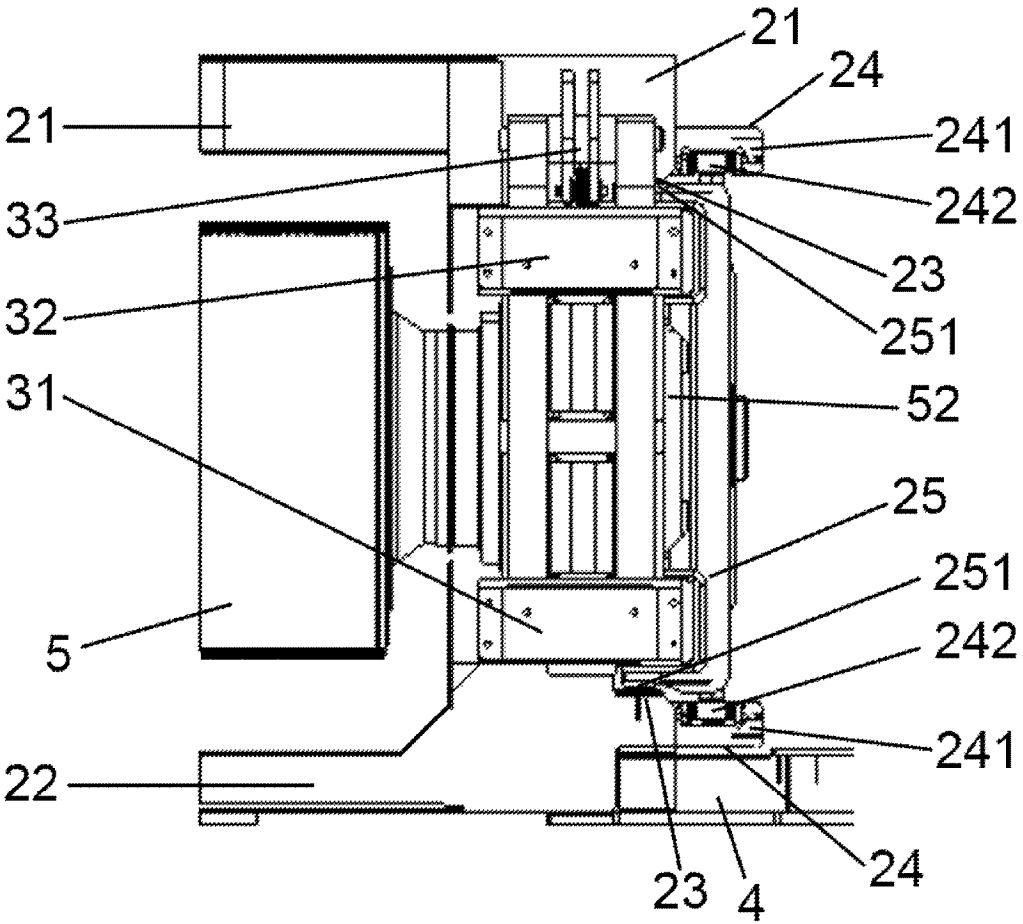
FIG. 4 is a side detail view of the fixed bearing side of the machine frame according to the present invention.

FIG. 4 shows a side view of the fixed bearing side of a machine frame 1 according to the present invention to illustrate the design of the roll mount in the machine frame 1, by which the axial forces are advantageously introduced only into the axial frame 2. Shown is a portion of a roll, here the fixed roll 5, a portion of the axial frame upper part 21 and of the axial frame lower part 22 as well as the lower chord system 31, the upper chord system 32 and a vertical spar pair 33 of the fixed bearing-side radial frame. Slideways 25, which have chambered sliding plates 251, preferably ones made of Teflon, at their upper and lower ends, are arranged at the bearing housing of the fixed bearing 52. The sliding plates 251 located outside, which are parts subject to wear, can be advantageously replaced without mounted rolls having to the removed from the frame. Support plates with sliding rails 23, preferably polished chromium sheets, are arranged as opposing sliding pieces at the axial frame upper part 21 and lower part 22, preferably by tack welds and/or screws. The rigid components 241 of the outer guides 24 are fastened to the axial frame upper part 21 and lower part 22. The movable components 242 of the outer guides 24 are arranged at the slideways 25. The slideways 25 are likewise used, connected to a traverse, not shown, as stop means for transporting and lifting the rolls.

While specific embodiments of the invention have been shown and described in detail to illustrate the application of the principles of the invention, it will be understood that the invention may be embodied otherwise without departing from such principles.

LIST OF REFERENCE NUMBERS

1 Machine frame
2 Axial frame
21 Axial frame upper part
22 Axial frame lower part
23 Support plate with sliding rail
24 Outer guide
241 Rigid outer guide components
242 Movable outer guide components
25 Slideway
251 Sliding plate
3 Radial frame
31 Lower chord system
311 Lower chord
32 Upper chord system
321 Upper chord
33 Vertical spar pair
331 Contact surface of vertical spars
34 Hydraulic cylinder with rubber thrust bearing, as a contact surface of the movable roll
36 Elastic damping element
37 Longitudinal beam element of the chord system
38 Head connection
39 Mounting holes
4 Foundation plate
5 Fixed roll
51 Fixed bearing of movable roll
52 Fixed bearing of fixed roll
6 Housing (indicated)
81 Centering pin
82 Hole for centering pin

What is claimed is:

1. A roll press comprising:

two rolls;

an axial frame for absorbing axial forces developing due to operation of the two rolls; and at least two radial frames configured for absorbing radial forces developing between the two rolls due to operation, the radial frames mutually intersecting with the axial frame, the radial frames comprising frame elements for absorbing the radial forces developing between the two rolls due to operation and are mounted elastically relative to the axial frame, the radial frame having long sides comprising a chord system having at least one of an upper chord and a lower chord, short sides of the radial frame have a force transmitting connection to the chords of the chord system via vertical spars, the chords of the chord system being mounted elastically.

2. A roll press in accordance with claim 1, wherein the axial frame comprises an axial frame upper part and an axial frame lower part.

3. A roll press in accordance with claim 2, further comprising a sliding means for the sliding motion of the two rolls.

4. A roll press in accordance with claim 3, wherein the sliding means for the sliding motion of the two rolls comprise support plates with sliding rails arranged at the axial frame and extending parallel to the radial frame, wherein sliding and guide elements are configured to be fastened to the two rolls during operation to form a system configured for displaceably guiding the two rolls.

5. A roll press in accordance with claim 1, wherein the vertical spars form spar pairs and at least one of the two vertical spar pairs of the radial frame is detachable.

6. A roll press in accordance with claim 1, wherein one of the two rolls is a moveable roll and another one of the two rolls is fixed roll, one of the two vertical spars of a radial frame has a contact surface for the movable roll and the other has a contact surface for the fixed roll.

7. A roll press in accordance with claim 1, further comprising a foundation plate wherein the foundation plate supports the axial and radial frames.

8. A roll press in accordance with claim 1, further comprising screw or centering pin connections wherein the axial frame and the radial frames are connected by the screw or centering pin connections.

9. A roll press in accordance with claim 1, wherein the axial frame is larger than the radial frames and the radial frames are located within the axial frame.

10. A roll press comprising:

two rolls;

an axial frame for absorbing axial forces developing due to operation of the two rolls; and a first radial frame; and a second radial frame, the first radial frame and the second radial frame being connected to the axial frame and configured for absorbing radial forces developing due to operation of the two rolls, the first and second radial frames mutually intersecting with the axial frame, each of the first radial frame and the second radial frame comprising elastic damping elements which are configured for absorbing radial forces due to operation of the two rolls, each of the first radial frame and the second radial frame having long sides comprising a chord system having at least one of an upper chord and a lower chord, each of the first radial frame and the second radial frame having short sides defining a force transmitting connection to the chords of the chord system via vertical spars, the chords of the chord system being mounted elastically via the elastic damping elements.

11. A roll press in accordance with claim 10, wherein the axial frame comprises an axial frame upper part and an axial frame lower part.

12. A roll press in accordance with claim 11, further comprising a sliding means for the sliding motion of the two rolls.

13. A roll press in accordance with claim 12, wherein the sliding means for the sliding motion of the two rolls comprises support plates with sliding rails arranged at the axial frame and extending parallel to the radial frame, wherein sliding and guide elements are configured to be fastened to the two rolls during operation to form a system configured for displaceably guiding the two rolls.

14. A roll press in accordance with claim 10, wherein the vertical spars form spar pairs and at least one of the two vertical spar pairs of the radial frame is detachable.

15. A roll press in accordance with claim 10, wherein one of the two rolls is a moveable roll and another one of the two rolls is fixed roll, one of the two vertical spars of the radial frame has a contact surface for the movable roll and the other has a contact surface for the fixed roll.

16. A roll press in accordance with claim 10, wherein the axial frame is larger than the radial frames and the radial frames are located within the axial frame.

17. A roll press arrangement comprising:

two rolls;

an axial frame configured to absorb axial forces from said two rolls during operation; and a radial frame intersecting with said axial frame, said radial frame including a chord configured to radially connect said two rolls during operation, said chord being configured to be tensioned by radial forces from operation of said two rolls, said radial frame including an elastic damping element connecting said chord to said axial frame, said elastic damping element being configured to absorb longitudinal stretching of said chord relative to said axial frame.

18. A roll press arrangement in accordance with claim 17, wherein:

the longitudinal stretching results from operation of said two rolls;

said elastic damping element is configured to absorb longitudinal stretching of said chord relative to other parts of said radial frame.

* * * * *